US005569027A

United States Patent [19]

Ball et al.

[11] Patent Number: 5,569,027

[45] Date of Patent: Oct. 29, 1996

[54] LOBED ROTOR MACHINE

[75] Inventors: Wilfried Ball, Dingolfing; Peter Rönnberg, Seeshaupt; Peter Pelz, Daimlerweg 2, D-82538 Geretsried, all of Germany

[73] Assignee: Peter Pelz, Geretsried, Germany

[21] Appl. No.: 512,493

[22] Filed: Aug. 8, 1995

[30] Foreign Application Priority Data

Aug. 10, 1994 [DE] Germany ..... 44 28 338.5

[51] Int. Cl.[6] ..... F01C 1/00

[52] U.S. Cl. ..... 418/35; 184/5; 418/94

[58] Field of Search ..... 184/5, 6.16, 24; 418/35, 36, 37, 38, 83, 94

[56] References Cited

U.S. PATENT DOCUMENTS 3,503,469 3/1970 Renz et al. ..... 184/5

3,890,939 6/1975 McIntosh ..... 418/36

FOREIGN PATENT DOCUMENTS 1024937 4/1953 France ..... 418/35

2262570 6/1993 United Kingdom ..... 418/35

*Primary Examiner*—Charles Freay

*Attorney, Agent, or Firm*—Anderson Kill Olick & Oshinsky, P.C.

[57] ABSTRACT

A lobed rotor machine including an annular cylinder chamber having inlet and outlet openings, four working pistons movable in pairs in the cylinder chamber, two piston carriers for supporting respective pairs of the working cylinder and rotatable about a common machine axis and displaceable relative to each other, and guide channels formed inside of each of the two piston carriers and defining supply channels and return channels for communicating cooling medium to the pistons.

6 Claims, 4 Drawing Sheets

LOBED ROTOR MACHINE

BACKGROUND OF THE INVENTION

The present invention relates to a lobed rotor machine comprising an annular cylinder chamber having inlet and outlet openings, four working pistons movable in pairs in the cylinder chamber, and two piston carrier for supporting respective pairs of the working cylinder, with the two piston carriers being rotatable about a common machine axis and displaceable relative to each other. In particular, the present invention relates to cooling means for the working pistons of a lobed rotor machine.

A comparable lobed rotor machine is disclosed, e.g., in EP 530,771 and is designed as an internal combustion engine. In an advantageous manner, the lobed rotor machine, which is disclosed in EP 530 771, comprises essentially only six movable parts, namely, two piston pairs formed of interlocking pistons and rotatable in the same direction with forming alternating work chambers having predetermined volumes, the piston pairs being associated with respective shafts and leavers, two connecting rods, a crankshaft, and a crankshaft housing with a main shaft and a relatively small crankcase with a cylinder. The lobed rotor motor operates in such a manner that each two rotation of the crank shaft correspond to four sequences of a four-stroke cycle including steps of suction, compression, operation and exhaust.

An object of the invention is to insure a sufficient and reliable cooling of such a machine and, in particular, cooling of the working pistons, by using as simple means as possible and by using the available hollow spaces.

SUMMARY OF THE INVENTION

This and other objects of the invention, which will become apparent hereinafter, are achieved by providing cooling means including guide channels formed inside of the two piston carriers, which are formed as flat circular discs, and defining supply and return channels extending at least to a vicinity of respective working pistons for conducting cooling medium thereto.

According to a preferred embodiment of the invention, the guide channels are formed by radial bores, and the cooling means further includes grooves provided in facing each other end surfaces of the piston carriers and communicating with respective guide channels, and connection bores formed in hub portions of respective piston carriers for communicating the respective guide channels with a cooling medium supply system and a cooling medium return system, respectively.

Advantageously lubricating oil is used as a cooling medium.

To prevent uncontrolled leakage of the cooling medium, i.e., the lubricating oil, into the cylinder chamber, sealing means is provided between the facing each other end surfaces of the piston carriers. Because the two piston carriers rotate relative to each other, a gap is provided between the facing each other end surfaces of the piston carriers.

To prevent short circuit flow between the supply of the cooling medium and the return of the cooling medium, sealing means is provided between grooves associated respectively, with the supply and return channels.

In the preferred embodiment of the invention, a pressure chamber for the cooling medium is formed by a gap between a hollow shaft, which is connected with the motor side piston carrier, and a hollow drive shaft. Alternatively, the pressure chamber may be defined by an inner space of the drive shaft. A return chamber for return cooling medium is formed by a gap between the hollow shaft, which is connected with the motor side piston, and a hollow shaft, which is connected with the control means side piston carrier.

BRIEF DESCRIPTION OF THE DRAWINGS

The features and objects of the present invention will become more apparent, and the invention itself will be best understood from the following detailed description of the preferred embodiment, when read with reference to the accompanying drawings, wherein.

DETAILED DESCRIPTION OF THE PREFERRED EMBODIMENT

Figure 1:
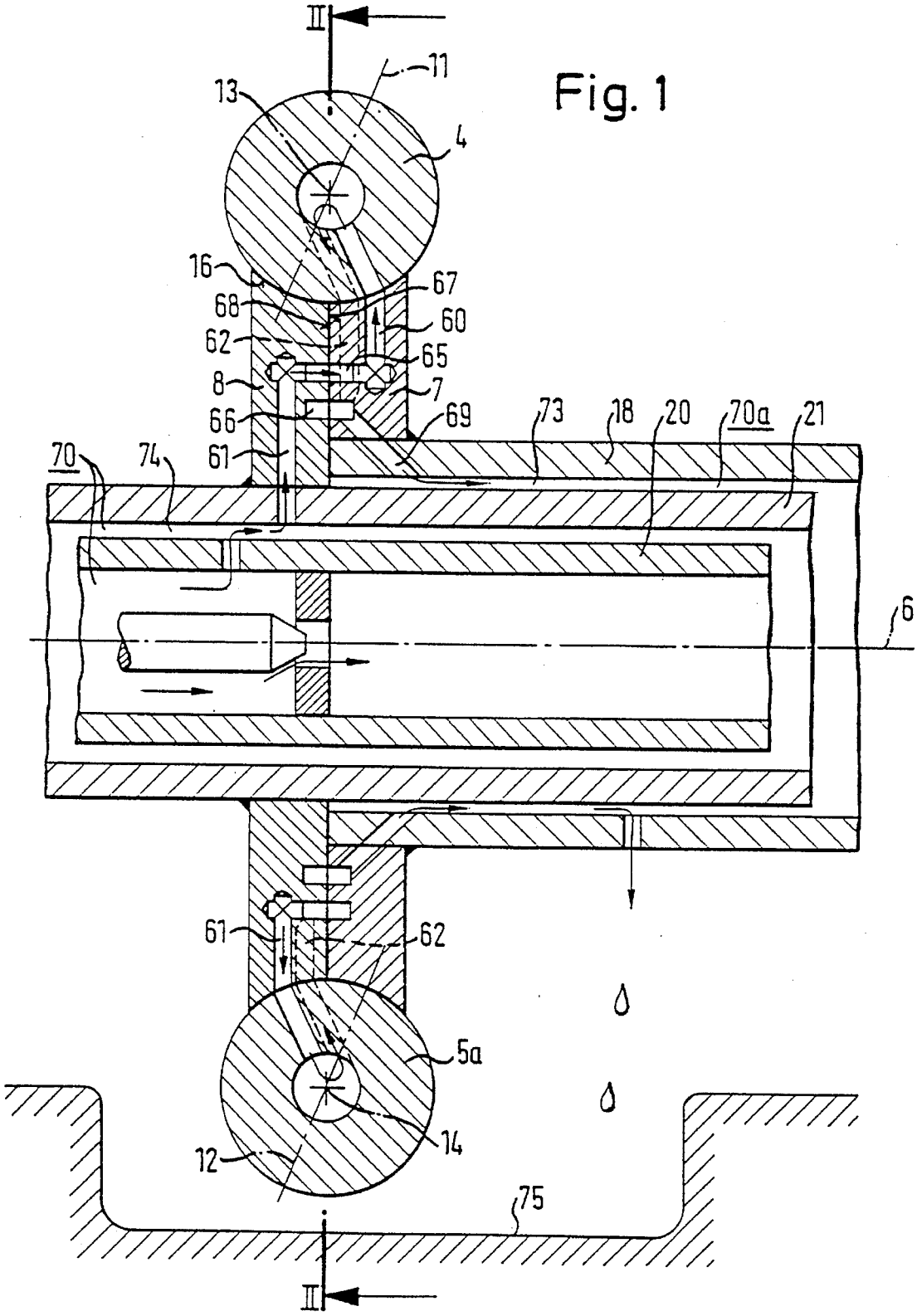
FIG. 1 shows a schematic longitudinal cross-sectional view of a lobed rotor machine according to the present invention.
Figure 2:
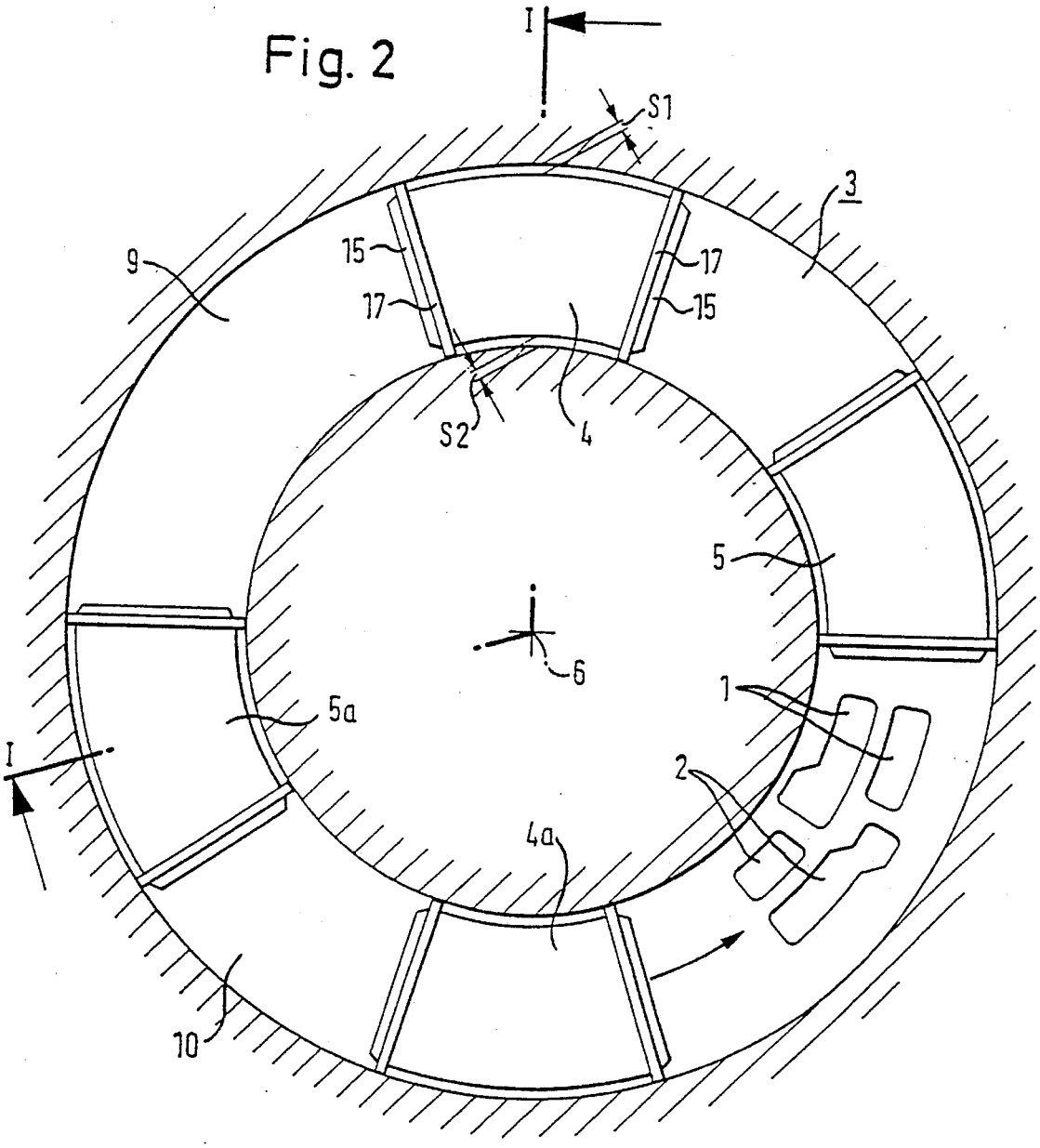
FIG. 2 shows a schematic cross-sectional view of a working piston taken along line II—II in FIG. 1.
Figure 3:
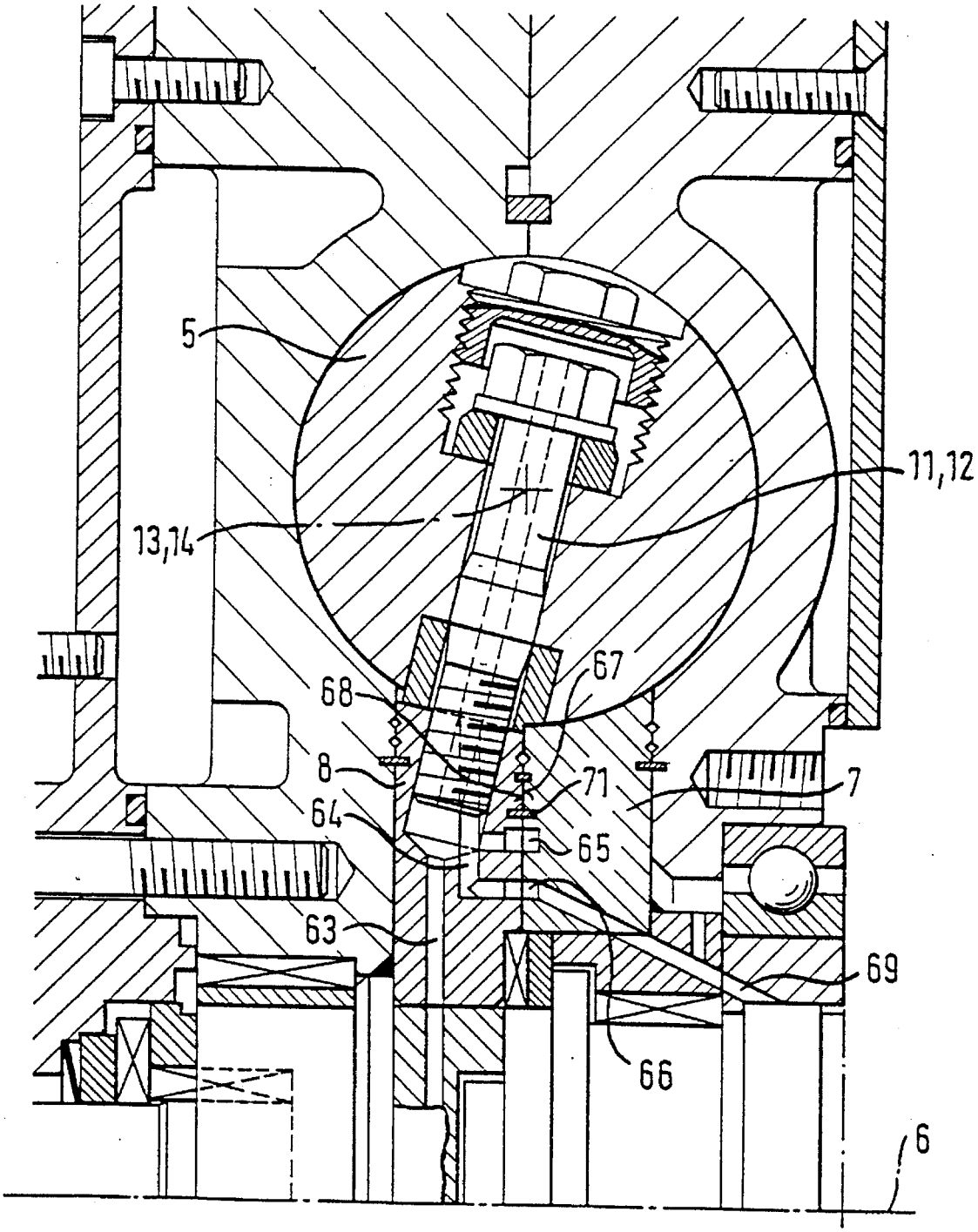
FIG. 3 shows a portion of a longitudinal cross-sectional view of a lobed rotor machine at an increased scale.
Figure 5:
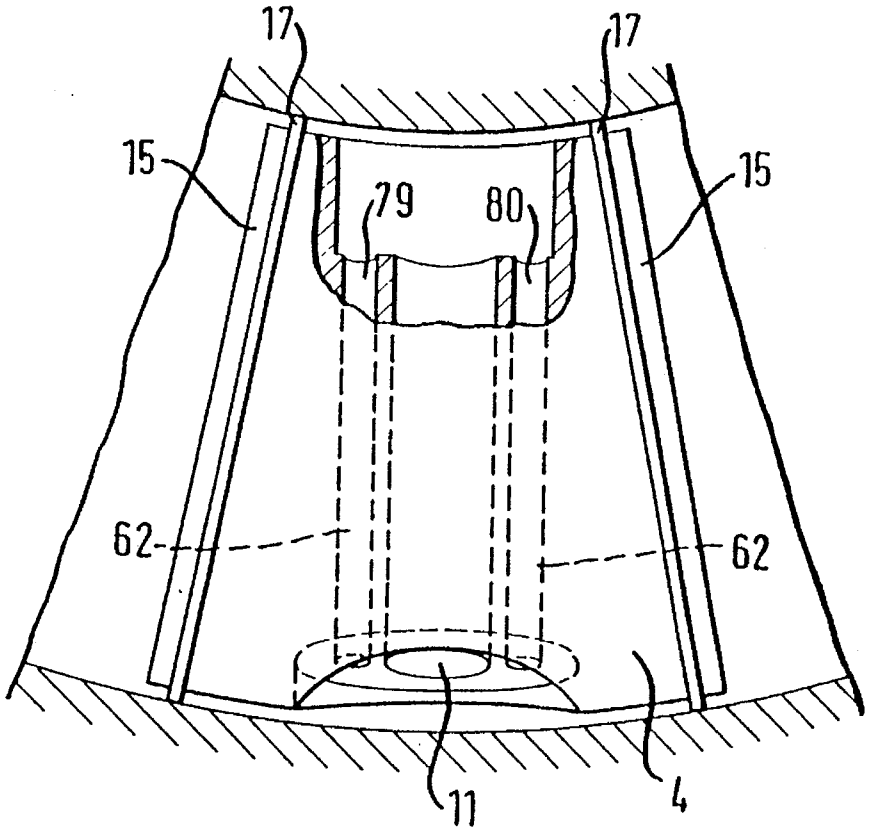
FIG. 5 shows a front cross-sectional view of a working piston at an increased scale.
Figure 4:
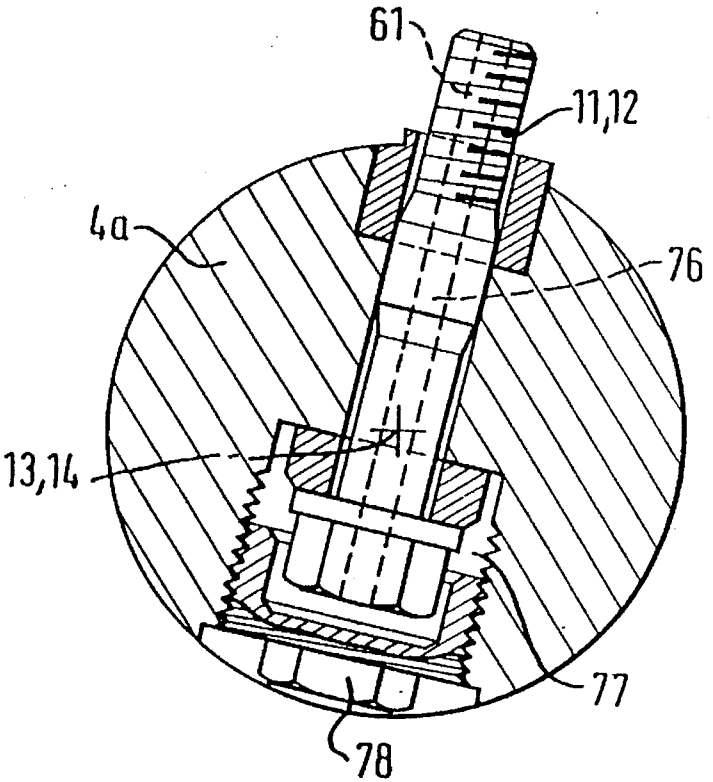
FIG. 4 shows a portion of a longitudinal cross-sectional view of a working piston at an increased scale.

A lobed rotor machine, which is schematically shown in the drawings, includes four working pistons, 4, **4*a*, 5, and 5*a* movable in pairs in an annular cylinder chamber 3 provided with spaced from each other inlet and outlet openings 1 and 2. The working pistons 4, 4*a*, 5, and 5*a* have a shape corresponding to the cylinder chamber 3 and are attached to or are formed integrally with two piston carriers 7 and 8, rotatable about a common main machine axis 6, movable relative to each other and having, in particular, a disc-like shape, with the working pistons 4 and 4*a* being arranged on the piston carrier 7 and the working pistons 5 and 5*a* being arranged on the piston carrier 8. Both piston carriers 7 and 8 are associated with a mechanical forced control, not shown in detail, which forces each of the piston carriers 7 and 8 to periodically change its rotational speed. In this way, to form a compression chamber 9, deceleration or stoppage of one of the piston carriers and a follow-up movement of another of the piston carriers is effected in one or several regions of the annular cylinder chamber 3. To form an expansion chamber 10, a following successive movement of the one piston carrier and a renewed follow-up movement of the another piston carrier is effected. The working pistons 4, 4*a*, 5, 5*a* are attached to the piston carriers and 7 and 8 with fastening screws 11 and 12 and in such a way that each screw axis extends perpendicularly to an associated circumferential surface of the associated piston carrier and through the gravity center 13 and 14** of the working pistons.

In another, not shown, embodiment, the working pistons can be secured to the piston carriers by elements which are radially arranged on the piston carriers and are rigidly form-lockingly engaged in complementary openings provided in piston bodies.

The annular cylinder chamber 3, in which the working pistons 4, **4*a*, 5, and 5*a* move, has advantageously a circular cross-section, so that the piston caps 15 of the working pistons 4, 4*a*, 5, 5*a* have a shape corresponding to the shape of the cylinder chamber 3**, with the working pistons being preferably but not necessarily formed as cylinder sections curved in a longitudinal direction.

According to the invention the piston carriers 7 and 8 are formed as circular, flat discs, the circumferential surface 16 of which has an accurate curve corresponding to the cross-section of the cylinder chamber 3.

In the embodiment according to the present invention, which is shown in the drawings, the piston carriers 7 and 8, which are formed as flat circular discs, have conduit channels 60 that form a supply channel 61 and a return channel 62. In the embodiment shown, the channels extend over the piston carriers 7 and 8 and further into a region inside the working pistons. For the purposes of the invention, it is, however sufficient, if the channels 60 extend at least to the vicinity of the working pistons, preferably to the vicinity of the piston caps where the most of heat is created.

The conduit channels 60 in the disc-shaped piston carriers 7 and 8, which extend radially to the machine main axis 6, are formed by bores 63 and 64. The bores 63 and 64 are connected, respectively, to a fluid system 70, not shown in detail, which is supplied by a pressure pump, and a return system 70 a via, respectively, grooves 65 and 66 formed, respectively, in facing each other end surfaces 67 and 68 of the piston carriers 7 and 8 and diagonal or connection bores 69 provided in hub regions of the piston carriers 7 and 8. Sealing means 71 is provided between the facing each other end surfaces 67 and 68 of the piston carriers 7 and 8 to prevent fluid leakage. Further, another sealing means is provided between the supply 61 and return 62 channels in the facing each other end surfaces 67 and 68 of the piston carriers.

As can be seen in FIG. 1, a pressure chamber, which is supplied by a pressure pump (not shown) and which forms part of the fluid system 70, is formed by a gap chamber 74 between a hollow shaft 21, which is connected to the motor end piston carrier 8, and an internal drive shaft 20. A chamber for receiving the fluid, which acts as a cooling medium, is formed by a gap chamber 73 between the hollow shaft 21, which is connected to the motor end piston carrier 8, and a hollow shaft 18 connected to the piston carrier 7 arranged at the control housing. A chamber, which may serve as a source of lubricant for a control housing (not shown), can be connected with the return channel for the fluid, which acts as a cooling medium. Alternatively, an oil sump 75 can be associated with the return channel, as shown in FIG. 1.

In the embodiment of the invention, which is shown in the drawings, the channel 60, which serves as supply channel, extends beyond the piston carrier 7 or 8 and is connected by a bore 76, which is formed in the fastening screw 11, 12 for the working piston and which represents a continuation of the supply channel, with a hollow chamber 77 inside the working piston, which is formed between fastening screws 11, 12 and locking screws 78 and the other side of which is connected by bores 79 and 80 (return channels), formed in the working piston, to the return.

Though the present invention was shown and described with reference to a preferred embodiment, various modification thereof will be apparent to those skilled in the art and, therefore, it is not intended that the invention be limited to the disclosed embodiment and/or details thereof, and departure can be made therefrom within the spirit and scope of the invention as defined in the appended claims.

What is claimed is:

1. A lobed rotor machine, comprising:

an annular cylinder chamber having inlet and outlet openings;

four working pistons movable in pairs in the cylinder chamber;

two piston carriers for supporting respective pairs of the working cylinder, each of the two piston carriers being formed as a flat circular disc, and the two piston carriers being rotatable about a common machine axis and being displaceable relative to each other; and means for cooling the working pistons, the cooling means comprising guide channels formed inside of each of the two piston carriers and defining a supply channel and a return channel extending at least to a vicinity of respective working pistons for conducting cooling medium thereto.

2. A lobed rotor machine as set forth in claim 1, wherein the guide channels are formed by radial bores, and wherein the cooling means includes grooves provided in facing each other end surfaces of the piston carriers and communicating with respective guide channels, and connection bores formed in hub portions of respective piston carriers for communicating the respective guide channels with a cooling medium supply system and a cooling medium return system, respectively.

3. A lobe rotor machine as set forth in claim 1, wherein lubricating oil is used as a cooling medium.

4. A lobe rotar machine as set forth in claim 2, further comprising sealing means provided between the facing each other end surfaces of the piston carriers.

5. A lobe rotor machine as set forth in claim 4, comprising further sealing means provided between grooves associated with the supply and return channels.

6. A lobe rotor machine as set forth in claim 1, further comprising an oil sump for receiving return cooling medium.

* * * * *